US006208328B1

(12) United States Patent
Kawachiya et al.

(10) Patent No.: US 6,208,328 B1
(45) Date of Patent: Mar. 27, 2001

(54) MANIPULATIVE POINTING DEVICE, AND PORTABLE INFORMATION PROCESSING APPARATUS

(75) Inventors: Kiyokuni Kawachiya, Kawasaki; Hiroshi Ishikawa, Shizuoka, both of (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/028,935

(22) Filed: Feb. 24, 1998

(30) Foreign Application Priority Data

Mar. 7, 1997 (JP) ..... 9-053158

(51) Int. Cl.[7] ..... G09G 5/08

(52) U.S. Cl. ..... 345/157; 345/161; 345/163; 345/173

(58) Field of Search ..... 345/161, 163, 345/123, 173, 125, 157, 160

(56) References Cited

U.S. PATENT DOCUMENTS

| | | | | |
|---|---|---|---|---|
| 4,616,115 | | 10/1986 | Potyka . | |
| 4,748,441 | * | 5/1988 | Brzezinski | 340/709 |
| 5,686,937 | * | 11/1997 | Li | 345/123 |
| 5,691,747 | * | 11/1997 | Amano | 345/167 |
| 5,724,068 | * | 3/1998 | Sanchez et al. | 345/161 |
| 5,786,810 | * | 7/1998 | Knox et al. | 345/168 |
| 5,821,921 | * | 10/1998 | Osborn et al. | 345/157 |
| 5,874,944 | * | 2/1999 | Khoury | 345/161 |
| 5,889,507 | * | 3/1999 | Engle et al. | 345/161 |
| 5,894,301 | * | 4/1999 | Seffernick | 345/160 |

FOREIGN PATENT DOCUMENTS 2110428A 6/1983 (GB) ..... B25J/13/02

OTHER PUBLICATIONS

EPO Search Report dated Jun. 7, 1998 (4 pages).

* cited by examiner

*Primary Examiner*—William A. Cuchlinski, Jr.
*Assistant Examiner*—Marthe Marc-Coleman
(74) *Attorney, Agent, or Firm*—Bernard D. Bogdon; Felsman, Bradley, Vaden, Gunter & Dillon, LLP

(57) ABSTRACT

A pointing device makes groping manipulation possible with a single finger and comprises a stick, a vector detection mechanism placed away from the stick by a predetermined distance so as to turn around the longitudinal axis of the stick, for outputting a signal corresponding to a force vector of a force applied by the stick when the stick contacts with the mechanism, and a detector for detecting a force applied in the longitudinal direction of the stick. In response to a signal output from the vector detection mechanism, it is judged whether an evaluation value of the force vector satisfies a predetermined condition. When the evaluation value of the force vector satisfies the predetermined condition, execution of a first kind of manipulation according to the evaluation value is instructed. When the evaluation value does not satisfy the predetermined condition, execution of a second kind of manipulation is instructed.

15 Claims, 11 Drawing Sheets

| | 1. Digital movement | 2. Two-dimensional movement | 3. High-speed movement | 4. One-hand manipu-lation | 5. Groping manipu-lation |
|---|---|---|---|---|---|
| a. Touch pad | ○ | ○ | ○ | × | × |
| b. Depress-able dial | ○ | × | △ | ○ | ○ |
| c. Cursor key | ○ | ○ | △ | △ | ○ |
| d. Track ball | × | ○ | ○ | △ | × |

FIG. 23

MANIPULATIVE POINTING DEVICE, AND PORTABLE INFORMATION PROCESSING APPARATUS

FIELD OF THE INVENTION

The present invention relates to a pointing device and a method for manipulating an information processing apparatus which employs the pointing device. More specifically, the invention relates to a pointing device where a physical insensitive zone is provided around a stick for indicating within a horizontal plane and a vertical direction can also be indicated and a method for manipulating an information processing apparatus which employs this pointing device to make both continuous manipulation (analog input) and one-unit manipulation (digital input) possible.

BACKGROUND OF THE INVENTION

Subminiature portable information processing apparatus, represented by personal digital assistants (PDAs), have been employed in various places due to the nature of the apparatus. In addition to the use of the portable information processing apparatus in vehicles such as trains and automobiles, if the apparatus is easily able to have access to information while standing in such a vehicle or while walking, it will be more convenient for use. However, in these circumstances, there are many cases where only one hand can be used.

The use for subminiature portable information processing apparatus that users can hold in one hand, as previously described, is mainly to access information, that is, information browsing. For example, the user selects a menu item as shown in FIG. 1A prior art and performs manipulation to display the contents of the selected menu item as shown in FIG. 1B prior art. In FIG. 1B, the display device of the portable information processing apparatus is small and all information within the menu cannot be displayed at a time, so there are cases where a scroll operation is performed. Such information browsing does not require that various information is input by an input means such as a keyboard, but, on the other hand, since there is the possibility that the user will employ this portable information processing apparatus while standing or walking, as described above, there is a need to design the manipulation interface so that the apparatus can be more easily manipulated than usual.

Now, if it is considered what requirements are imposed on the aforementioned interface, they will be as follows. That is, (1) To be able to perform digital movement from a current item to the next selectable item. The digital movement means that movement is performed from item to item. (2) To be able to perform two-dimensional movement from a current item to upper, lower, left, and right items. It is necessary to be able to move to all points on a display screen. (3) To be able to perform high-speed movement from a current item to a far item and scrolling. It is necessary to be able to perform continuous manipulation in an analog manner. (4) To be able to perform manipulation with one hand, including selection (invocation) of an item. It is necessary to be able to perform so-called click and double click. Particularly, if positioning cannot be easily made, double click cannot be performed. (5) To be able to perform manipulation even by feel. If operating circumstances are considered, a physical response to the manipulating hand will be an important element.

On the other hand, the following input devices are known as conventional input devices for portable information processing apparatus: (a) direct input by a pen and a touch pad; and (b) depressible digital dials. In the digital dial, if the dial is turned, a cursor will be moved in a one-dimensional direction, and when giving selection, the dial can be depressed. The dial is used for digital input. Each time the dial is turned a constant angle, a feedback is given to users and input of one unit is performed. A further device includes (c) a combination of cursor keys and a switch. They are cursor keys provided in a keyboard or a cross-shaped key provided in some of small game machines for indicating a direction, and a switch for selection. Yet another is (d) a combination of an analog input device (such as a track ball) and a switch.

The cursor key basically indicates movement which is performed one unit at a time. If the key continues to be pushed, the cursor will be moved continuously, but this merely means that digital inputs arise continuously. On the other hand, track balls or force sensible input devices, provided within the keyboard of a notebook computer produced by IBM Corporation, indicate continuous movement corresponding to the amount of rotation of the ball or the strength of a force applied to the force sensible input device, and therefore they give information processing apparatus an analog input.

The aforementioned input device (a) has the advantage that handwritten figures and characters can be directly input but has the disadvantage that both hands are needed even when it is employed for simple menu manipulation. Also, groping manipulation is difficult. The aforementioned input device (b) makes groping manipulation by one hand possible, but it requires mode switching, for example, when moving menu items right and left, because the device gives a one-dimensional input. The aforementioned input device (c) gives a two-dimensional input and therefore does not cause a problem such as (b). However, since an additional switch generally is needed for item selection, one-hand manipulation becomes difficult. In addition, in the input devices (b) and (c), high-speed movement between far items is not easy. The aforementioned input device (d) can easily perform high-speed movement because it gives a two-dimensional analog input, but it requires an additional switch for item selection, as in the case of (c). In addition, digital movement to an adjacent item and groping manipulation are difficult. Thus, it is found that any of these input devices does not completely meet the aforementioned 5 requirements. FIG. 23 shows whether or not each of the aforementioned input methods meets the five requirements. In FIG. 23, the mark "○" means that an input method meets a requirement, the mark "Δ" means that an input method has difficulty slightly but can deal with, and the mark "x" means that an input method does not meet a requirement.

In Japanese Published Unexamined Patent Application No. 4-263308, by moving a manipulation knob left and right, back and forth, and up and down, a detecting sensor section outputs a signal about an X, Y, and Z direction in correspondence with the direction in which the manipulation knob is moved. Furthermore, by providing a rotary encoder which outputs a signal by rotating the manipulation knob, a joy stick can set a numerical value in each direction. This joy stick can indicate X, Y, and Z directions, but cannot set a numerical value by moving the manipulation knob in the direction. Therefore, the user cannot manipulate the joy stick by intuition. There is no description of an insensitive zone. Also, it is described that the input in the Z direction can be employed as a mere switch. For X and Y directions, there is no description of a method which makes the aforementioned analog and digital inputs possible.

Japanese Published Unexamined Patent Application No. 61-147326 discloses an input device having a structure where a lever is rotatable on its lower end in an arbitrary direction and a circular plate is fixed to the lever by insertion, and 4 tack switches are provided away from the outer circumference of the circular plate by a predetermined length so that the switches make a right angle with each other. This input device has a structure where the lever returns to its original position if the user's hold of the lever is released. Furthermore, for the Z-axis direction, information as to the manipulation of the lever can be obtained with a slide volume knob or a switch.

It is disclosed that the detection of the displacements in X-axis and Y-axis directions can employ not a tack switch but a displacement-electric quantity conversion element. This input unit is constructed so that the displacements in X-axis and Y-axis directions can be detected with 4 detectors making a right angle with each other. Therefore, in the case where it is desired that the lever is continuously varied in direction, that is, in the case where the lever is moved while both the direction from the X-axis direction to the Y-axis direction and the displacement in that direction remain indicated, there are cases where the continuous movement of the lever cannot be continuously detected, because no detector is provided between the X axis and the Y axis.

Japanese Published Unexamined Patent Application No. 2-188819 discloses that a mouse indicates horizontal movement and that if a specific mouse button is pushed, a predetermined item will be moved one unit at a time. In such a device, an analog input is indicated with the ball of the mouse and a digital input is performed with the button of the mouse. However, since a digital input cannot be indicated with the ball of the mouse which indicates position change, a predetermined item can be only moved one unit at a time. That is, movement of an item cannot be performed in an arbitrary direction. Also, this input device cannot be manipulated with one hand, because it employs a mouse.

Japanese Published Unexamined Patent Application No. 59-33539 discloses a device where, when the inclination of a joy stick is within a predetermined range, a marker on the display screen is moved in correspondence with the inclination and, when the inclination exceeds the predetermined range, the marker is repeatedly moved in the direction by a constant quantity at a time. It is described that this device has both a mode where movement of a marker is small and positioning is easy and a mode of moving a marker at high speed, but only the marker can be manipulated on display screen. Also, no description is made of manipulation in a Z-axis direction and an insensitive zone. Furthermore, this device has the disadvantage that manipulation will be difficult if the user does not view the display screen, because switching of modes is determined by the inclination of the joy stick.

Japanese Published Examined Patent Application No. 64-8846 discloses a device which continuously outputs a cursor-moving pulse when the inclination of a joy stick is greater than a predetermined angle for a period longer than a predetermined time. The device also outputs a single cursor-moving pulse when the inclination of the joy stick is greater than the predetermined angle for a period shorter than the predetermined time. Even in this device, what is manipulated in both modes is only a cursor. Also, there is no description of the manipulation in a Z-axis direction. Furthermore, this device has the disadvantage that manipulation will be difficult if the user does not view the display screen, because made switching is determined by the inclination of the joy stick and the time of the inclination.

Japanese Published Unexamined Patent Application No. 5-241502 discloses that scrolling of a display screen is performed with a joy stick. However, this publication does not disclose that the scroll operation and other different operations are combined and executed.

Note that an example of a pointing device provided on a keyboard is described in Japanese Published Unexamined Patent Application No. 7-302162. In this publication there is disclosed a device where force is applied to a stick provided on the keyboard in X-axis and Y-axis directions and where strain, produced in the stick by the force, is detected by a strain gauge, an electrostatic capacity detection sensor, a magnetic detection sensor, or a pressure sensitive detection sensor. In this device, no description is made of an input in a Z-axis direction, and only an analog input is possible. Also, a physical insensitive zone does not exist.

On the other hand, in IBM: Technical Disclosure Bulletin (TDB) (95-07, p 487), for a nearly similar structure, it is described that a pressure sensor is provided under a stick to detect a vertical input from the stick and that emulation is performed with a 3-button mouse along with two buttons normally provided. However, this publication, as with Japanese Published Unexamined Patent Application No. 7-302162, does not disclose that a digital input is performed only with the manipulation of the stick. Also, there is no description of a physical insensitive zone.

SUMMARY OF THE INVENTION

As described above, the conventional devices do not meet all of the aforementioned five requirements. Accordingly, an objective of the present invention is to provide an improved input device which meets the requirement that (1) digital movement can be made from a current item to the next selectable item, (2) two-dimensional movement can be made from a current item to upper, lower, left, and right items, (3) high-speed movement from a current item to a far item and scrolling can be made, (4) manipulation can be performed with one hand, including selection (invocation) of items, and (5) manipulation can be performed even by feel without looking at the display.

An additional objective of the present invention is to provide an improved method to process an input from an input device so that the aforementioned manipulations can be carried out and which executes manipulation of an information processing apparatus.

An input device for achieving the aforementioned objects has a stick, a vector detection mechanism placed away from the stick by a predetermined distance so as to turn around an axis of the stick, for outputting a signal corresponding to a contact direction and the strength of a force applied in the contact direction when the vector detection mechanism contacts with the stick, and a detector for detecting a force applied in an axial direction of the stick. Between the stick and the vector detection mechanism, there is provided space. This space constitutes a physical insensitive zone. By providing such a physical insensitive zone, a cursor on a display screen does not move if the stick does not contact with the vector detection mechanism.

Therefore, even in groping manipulation, manipulation such as click can be performed at a fixed place without causing unintentional movement, by the detector which detects a force applied in the axial direction of the stick. Also, the vector detection mechanism is placed so as to turn around the axis of the stick. Therefore, as previously described, even if the stick is moved along the vector detection mechanism, the mechanism can sufficiently follow the movement and continuously indicate the strength and direction of the applied force. Placing the mechanism so as to turn around the axis of the stick is intended to mean that the mechanism is placed so as to substantially turn around the axis. Therefore, in some cases, a notch may be provided in the mechanism.

The pointing device may further have a mechanism for returning the stick, shifted from its initial position, to the initial position. In this case, if a user, who tries to perform a digital input, tilts the stick in a desired direction to push the vector detection mechanism and then release the hold of the stick, the stick will return to its initial position. Therefore, the user can obtain a feeling of click in the desired direction, and groping manipulation becomes easy.

The detector for detecting a force applied in the axial direction of the stick may be a switch. A switch which can input ON/OFF information is sufficient for selection of an item. On the other hand, if an analog input is needed in a vertical direction, it is also possible to provide a pressure sensor. This can be employed for analog indication in a Z-direction and zooming.

The switch may be provided in the stick. The switch may also be provided on either end of the stick or in the intermediate portion of the stick. The switch may be provided at a position which is pushed by one end of the switch when the other end of the stick is pushed in the axial direction of the stock. That is, the switch can also be provided on another member which is on the extension of the axis of the stick.

The aforementioned vector detection mechanism may include a member that is placed around the stick so as to be away from the stick by a predetermined distance and that has a circular portion which is contacted by the stick. The mechanism may further include a sensor for detecting the strength and direction of a force applied to the member by the stick. If the member, which is contacted by the stick, is circular in shape (i.e., the stick passes through a circular hole formed in the member), the direction of a force applied to the member by the stick will be detected appropriately. The sensor may be provided directly on this member, and it is also possible to detect the strength and the direction of a force which is transmitted through a support member that supports this member. The type of the sensor may be a strain gauge type, a pressure sensor type, or an electrostatic capacity sensor type.

The aforementioned pointing device is more effective if it is provided in a portable information processing apparatus, as described in the Background. Also, the pointing device may be connected to an ordinary information processing apparatus as a separate device, or it may be provided on an ordinary keyboard.

When this pointing device is provided in a portable information processing apparatus, it may be provided on the side surface of the apparatus so that the axis of the stick is substantially parallel to the display device. The pointing device may also be provided on the same surface of the display device.

A method for manipulating an information processing apparatus of the present invention includes the steps of: in response to an input signal from a pointing device, judging whether an evaluation value of the input signal satisfies a predetermined condition; performing a first kind of manipulation according to the evaluation value when the evaluation value satisfies the predetermined condition; and performing a second kind of manipulation when the evaluation value does not satisfy the predetermined condition. With this, a mode change can be performed. That is, if the evaluation value satisfies a predetermined condition, the signal from the pointing device is taken to be an analog input. If the evaluation value does not satisfy a predetermined condition, the signal is taken to be a digital input. The first kind of manipulation may be continuous manipulation which scrolls the screen of a display device of the information processing apparatus, and the second kind of manipulation may be manipulation which changes a focused item on the screen by one unit at a time. Also, the evaluation value of the input signal may be a value corresponding to the magnitude of a vector signal which is output from the pointing device. In such a case the predetermined condition is that the magnitude is greater than a predetermined threshold value.

The method of the present invention may execute the steps of: judging whether the evaluation value satisfies a second predetermined condition in response to an input signal from the pointing device; performing the judging step and the steps thereafter when the evaluation value satisfies the second predetermined condition; and ignoring the input signal when the evaluation value does not satisfy the second predetermined condition. When a physical insensitive zone does not exist and there is no such a second condition (which is a second threshold value if the evaluation value is a value corresponding to the magnitude of a vector), the second kind of manipulation will be executed if a user only touches the stick. A phenomenon such as this will reduce usability.

It is preferable that the pointing device, which is employed in the method for manipulating an information processing apparatus, is the aforementioned pointing device. However, the method of the present invention is not limited to such a pointing device, but it is applicable to track balls and a pointing device on a keyboard such as is described in Japanese Published Unexamined Patent Application No. 7-302162. However, if the aforementioned pointing device is employed, the user can sensibly adjust whether the user performs the first kind of manipulation or the second kind of manipulation.

The method for manipulating an information processing apparatus may further include a step of selecting an item on the screen of the display device of the information processing apparatus in response to an output from the detector for detecting a force applied in the axial direction of the stick. With the aforementioned pointing device, a click operation can be executed when the user simply pushes the stick.

A portable information processing apparatus of the present invention comprises a pointing device which has a stick, a vector detection mechanism placed around an axis of the stick, for outputting a signal corresponding to a force vector of a force applied by the stick when the stick contacts with the mechanism, and a detector for detecting a force applied in an axial direction of the stick. The portable information processing apparatus further comprises a controller for, in response to a signal output from the vector detection mechanism, judging whether an evaluation value of the force vector satisfies a predetermined condition, and for instructing the execution of a first kind of manipulation according to the evaluation value when the evaluation value satisfies the predetermined condition, and for instructing the execution of a second kind of manipulation when the evaluation value does not satisfy the predetermined condition. With this arrangement, the apparatus becomes most convenient for use.

Note that it will be apparent to those skilled in this art to realize the aforementioned manipulation method by a program. It is also possible to carry out the manipulation method by electronic circuitry.

In accordance with the present invention, there is provided an input unit which meets the requirement that (1)

digital movement can be made from a current item to the next selectable item, (2) two-dimensional movement can be made from a current item to upper, lower, left, and right items, (3) high-speed movement and scrolling can be made from a current item to a far item, (4) manipulation can be performed with one hand, including selection (invocation) of items, and (5) manipulation can be performed even by feel.

There is also provided a method which processes input signals from an input unit to implement the aforementioned manipulations.

Finally, if a mechanical structure is made into the aforementioned structure, there will be also the advantage that waterproofing can be easily performed, because the structure has no portion which infinitely rotates like track balls or depressible dials.

BRIEF DESCRIPTION OF THE DRAWINGS

Preferred embodiments of the present invention will now be described, by way of example only, with reference to the accompanying drawings in which:

FIG. 23 is a table of requirements for input devices.

DETAILED DESCRIPTION OF THE PREFERRED EMBODIMENTS

Figure 1A:
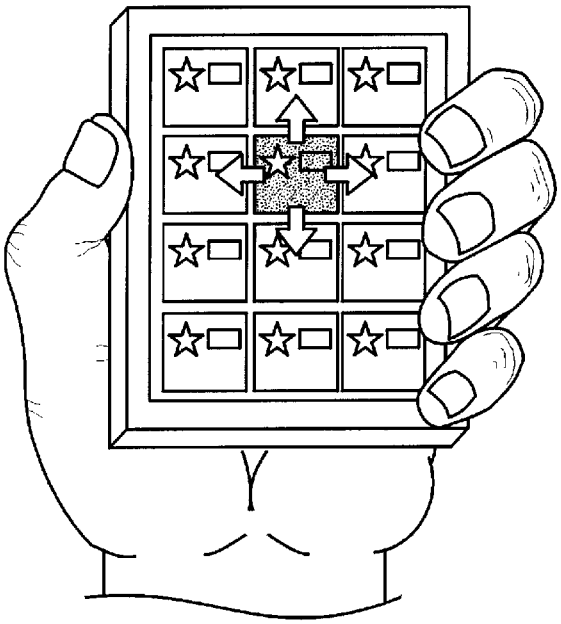
FIG. 1A (Prior Art)
FIGS. 1A and 1B are diagrams showing a display example of a prior art portable information processing apparatus, a plurality of items being shown in FIG. 1A and the contents of one item in FIG. 1A being shown in FIG. 1B.

The following is a description of the reference characters used to describe the illustrated elements: 1 . . . Stick; 1*a* . . . Stick's upper portion; 1*b* . . . Stick's lower portion; 1*d* . . . Taper portion; 1*e* . . . Protrusion; 3 . . . Ring; 3*a* . . . Ring's inner surface; 5 . . . Support member; 7 . . . Mounting surface; 9 . . . Microswitch; 11, 11*a*, 11*b*, 11*c*, 11*d*, 11*e* . . . Sensor; 17 . . . Sleeve; 15 . . . Slit; 19 . . . Force detecting plate; 21 . . . Plate support board; 23, 23*a*, 23*b*, 23*c*, 23*d* . . . Pressure sensor; 25 . . . Hole; 27, 27*a*, 27*b*, 27*c* . . . Electrostatic capacity sensor; 27*a* . . . Electrode; 27*b* . . . Dielectric substance; 29 . . . Elastic body; 31 . . . Switch; 33 . . . Switch; 35 . . . Stick holding mechanism; 37 . . . Stick support plate; 39*a*, 39*b* . . . Elastic body; and 500 . . . Pointing device.

(1) Mechanical Structure

Figure 2:
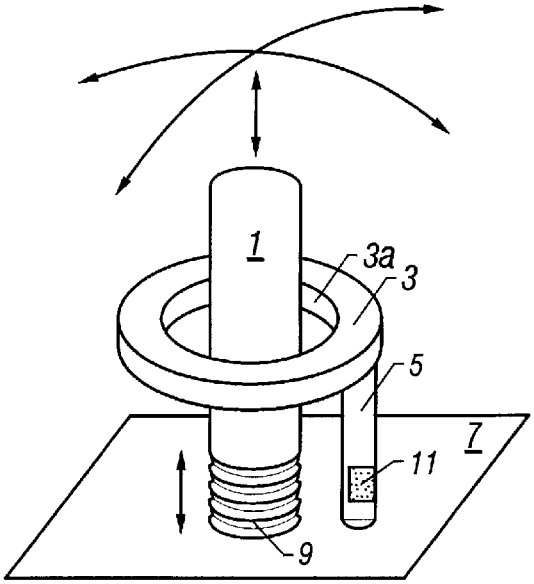
FIG. 2 is a schematic view showing the mechanical structure according to the principles of the present invention.

Initially, a description will be made of the mechanical structure of a pointing device. In FIG. 2 there is shown a schematic view of the pointing device of the present invention. A stick 1 is provided so as to be substantially perpendicular to a mounting surface 7 and inserted through a ring 3. It is preferable that the center of the ring 3 be aligned with that of the stick 1. It is also preferable that the inner portion of the ring 3 be formed into a circular shape the user can continuously change the indication of a direction, but the inner configuration can be an ellipse similar to a circular. A support member 5 supports the ring 3 so that the ring 3 is substantially parallel to the mounting surface 7 at a predetermined height. The predetermined height is determined by the inner diameter of the ring 3 and the height of the stick 1. The lower end of the stick 1 is provided with a microswitch 9. In FIG. 2 the microswitch 9 has both a function of switching and a function of returning and holding the stick 1 to its initial position when the stick 1 is tilted. Specifically, with a method which joins an elastic body, such as an elastic rubber or spring, to the lower end portion of the stick 1 and joins a switch to this elastic body, a vertical input can be detected and the stick 1 can be returned and held to the initial position. The microswitch 9 is provided on the mounting surface 7.

In FIG. 2 the sectional configuration of the ring 3 is rectangular or square, but it may be circular. The configuration of the support member 5 is also arbitrary. The support member 5 and the ring 3 may be joined together by adhesion or insertion, or they may be formed integrally. Also, the support member 5 and the mounting surface 7 may be joined together in a similar manner. A sensor 11 detects a direction in which the stick 1 is tilted and a force applied to the ring 3 by the stick 1, and in the case of FIG. 2 it is preferable that the sensor 11 be constituted by a strain sensor such as a strain gauge sensor. The sensor 11 is attached to the side surface of the support member 5, as shown in FIG. 2, or it can be attached near the proximal portion of the stick 1 on the mounting surface 7. While the microswitch 9 has been described as a switch, a device such as a pressure sensor may be provided instead of the switch, because there are cases where an analog input in a direction perpendicular to the mounting surface 7 is needed depending upon applications.

Figure 3:
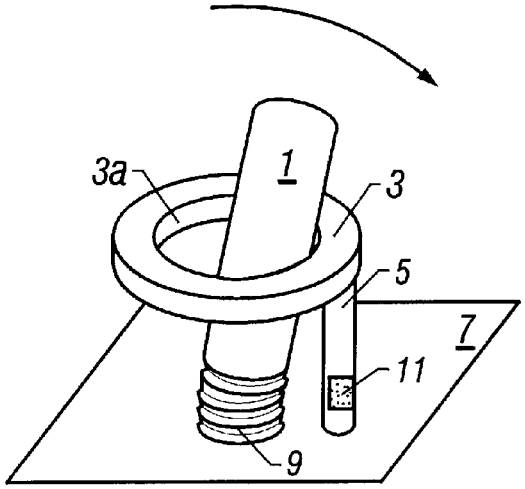
FIG. 3 is a diagram when the stick 1 in FIG. 1 is tilted.

The operation of the pointing device of FIG. 2 will next be described. The upper end of the stick 1 rotates on the joined portion between the microswitch 9 and the mounting surface 7. However, until the stick 1 contacts with the ring 3, the motion of the stick 1 is not detected by the sensor 11. This space between the stick 1 and the ring 3 is a physically provided insensitive zone. When the upper end of the stick 1 is tilted at a large angle, it will be brought into contact with the inner side (3*a*) of the ring 3, as shown in FIG. 3. If the upper end of the stick 1 is further tilted, the force applied to the stick 1 will be applied to the ring 3 in the direction in which the stick 1 is tilted. The force, applied to the ring 3, is detected as strain by the sensor 11 provided on the support member 5 through the support member 5. The output from the sensor 11 is converted in a subsequent process to a signal corresponding to the direction and strength of the force. Thus, if a force is applied to the stick 1 across the physical insensitive zone, a user will feel a physical response on the user's fingers. This will give a feeling of click when a subsequent digital signal is input. On the other hand, if the user releases user's hold of the stick 1 or if the force applied to the stick 1 becomes smaller than the restoring force of the elastic body of the microswitch 9, the stick 1 will try to return to the initial position. With this, the user can manipulate the stick in any direction with even sensibility.

Figure 1B:
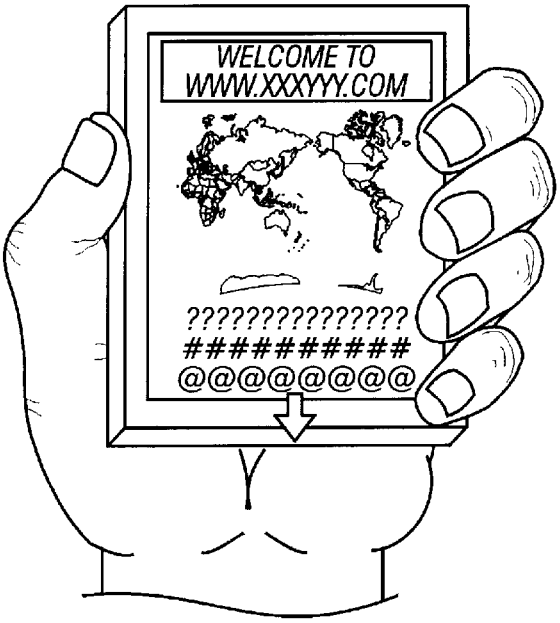
FIG. 1B (Prior Art)

In the case where the user selects one item from one or a plurality of items, as shown on the left side of FIG. 1, the user depresses the stick 1. The depressed stick 1 depresses the microswitch 9 through the elastic body joined to the lower end of the stick 1. Then, the microswitch 9 outputs an ON signal. At this time, since there is an insensitive zone between the stick 1 and the ring 3, the indicated position does not change so long as the stick 1 does not touch the ring 3, even if the stick were slightly depressed back and forth or left and right. Therefore, even in a groping situation, the selecting operation can be performed at a desired position. Also, in the case where a double click operation is performed, although the same point must be selected and indicated twice, a pointing device such as this can easily select and indicate the same point twice. Furthermore, in certain circumstances, if the stick 1 is depressed and tilted in a desired direction, the pointing device of the present invention can perform a drag operation which is generally performed with a mouse.

As described above, the pointing device of the present invention has three important mechanisms: (a) a mechanism (the ring 3, the support member 5, the mounting surface 7, and the sensor 11 of FIG. 2) which has a physical insensitive zone and detects horizontal indication made by the stick 1, (b) a mechanism for detecting a force in a direction perpendicular to the mounting surface 7, and (c) a mechanism of returning and holding the stick 1 to the initial position. Therefore, variations will hereinafter be described for each mechanism.

(a) Mechanism for Detecting Horizontal Indication

1. Scaffold Type

Figure 4:
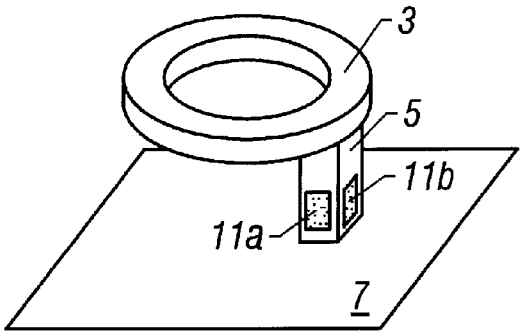
FIG. 4 is a diagram showing an example of a mechanism which has a physical insensitive zone and which detects horizontal indication given by the stick 1.

As shown in FIG. 2, the configuration, where the ring 3 is contacted by the stick 1 and supported by the support member 5, is referred to as a scaffold type. FIG. 4 shows only a portion constituting this scaffold. A ring 3 is the same as the aforementioned, while a support member 5 employs a square pillar. Sensors 11*a* and 11*b* are provided on the four side surfaces of the square pillar (in FIG. 4 only two side surfaces are shown). Even in such a structure, a force which is applied to the ring 3 can be sufficiently detected.

Figure 5:
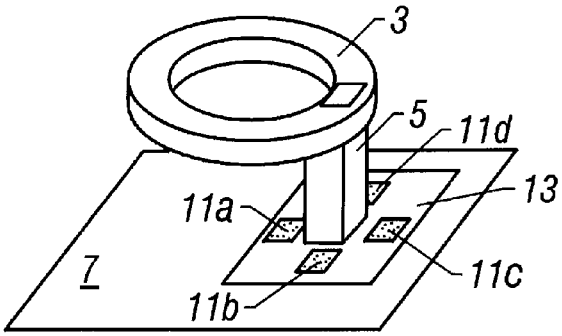
FIG. 5 is a diagram showing an example of a mechanism which has a physical insensitive zone and which detects horizontal indication given by the stick 1.

Also, a detecting base 13, to which a force is further transmitted through the support member 5, can be joined to the support member 5 and sensors 11*a*, 11*b*, 11*c*, and 11*d* can be provided on this detecting base 13 (FIG. 5). For the detecting base 13 and the support member 5, they are formed integrally or separately as long as they are joined together so that the force applied to the ring 3 can be easily detected. Also, both the detecting base 13 and the mounting surface 7 is sufficiently fixed together so that strain can be easily detected. In FIG. 5 the support member 5 is fixed to the ring 3 by insertion.

Figure 6:
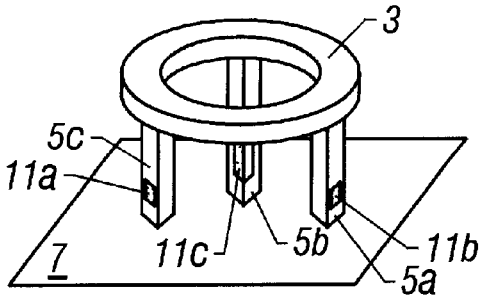
FIG. 6 is a diagram showing an example of a mechanism which has a physical insensitive zone and which detects horizontal indication given by the stick 1.

In FIG. 6 there is shown an example of the case where three support members 5*a*, 5*b*, and 5*c* are employed. Sensors 11*a*, 11*b*, and 11*c* can also be provided on the support members 5*a*, 5*b*, and 5*c*. In FIG. 6, while the support members 5*a*, 5*b*, and 5*c* employ triangular pillars, they may be square pillars.

Figure 7:
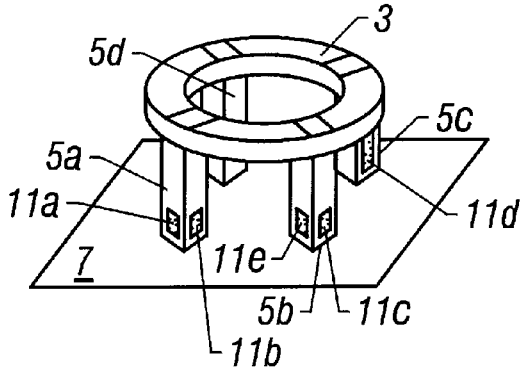
FIG. 7 is a diagram showing an example of a mechanism which has a physical insensitive zone and which detects horizontal indication given by the stick 1.

FIG. 7 shows an example of the case where four support members 5*a*, 5*b*, 5*c*, and 5*d* are employed. The support members 5*a*, 5*b*, 5*c*, and 5*d* are fixed to the ring 3 by insertion. Also, sensors 11*a*, 11*b*, 11 c, 11*d*, and 11*e* are provided on the side surfaces of each pillar (sensors on hidden surfaces are omitted). In this case 16 sensors are provided. Of course, a single sensor or two sensors may be provided on each pillar.

In a scaffold type such as described above, the number of support members and the configuration of support members are arbitrary, and the number of sensors may be any number if vectors on a horizontal plane can be detected. Also, the sensor may be provided on the side surface of a support member or on the detecting base provided on each support member.

2. Sleeve Type

Figure 8:
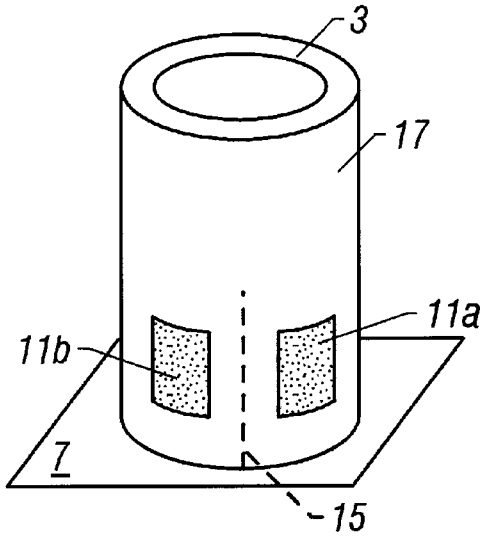
FIG. 8 is a diagram showing an example of a mechanism which has a physical insensitive zone and which detects horizontal indication given by the stick 1.
Figure 9:
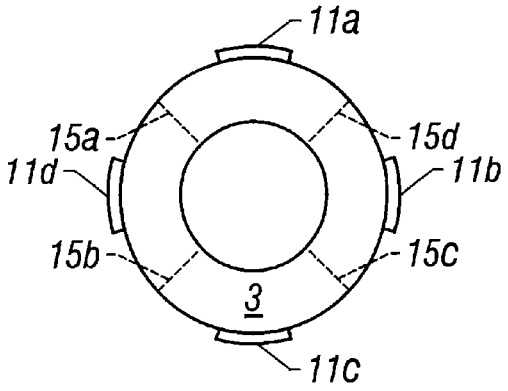
FIG. 9 is a cross sectional view of FIG. 8.

FIG. 8 shows an example of the case where a sleeve 17 with an inner diameter larger than the outer diameter of the stick 1 is employed. In the figure, the stick 1 and the switch are omitted. As shown in FIG. 8, if the sleeve 17 is provided on the mounting surface 7, the support member 5 is not needed as in the case of the scaffold type. In the example of FIG. 8, four sensors 11*a*, 11*b*, 11*c*, and 11*d* are attached to the side surface of the sleeve 17 (see FIG. 9). Also, as in the case of FIG. 5, the sleeve 17 may be provided on the detecting base and sensors may be provided on the detecting base. In addition, it is possible to provide a slit 15 (slits 15*a*, 15*b*, 15*c*, and 15*d* in FIG. 9) so that the sleeve 17 can be easily bent. The number of slits 15 is arbitrary as in the number of support members in the scaffold type. The number of sensors may be any number if vectors on a horizontal plane can be detected. In FIG. 8, while the sleeve 15 has the same inner diameter and the same outer diameter from its upper end to its lower end, the sleeve 15 may be replaced with a sleeve having large inner and outer diameters at its upper end or a sleeve having large inner and outer diameters at its lower end.

3. Plate Sliding Mechanism

Figure 10:
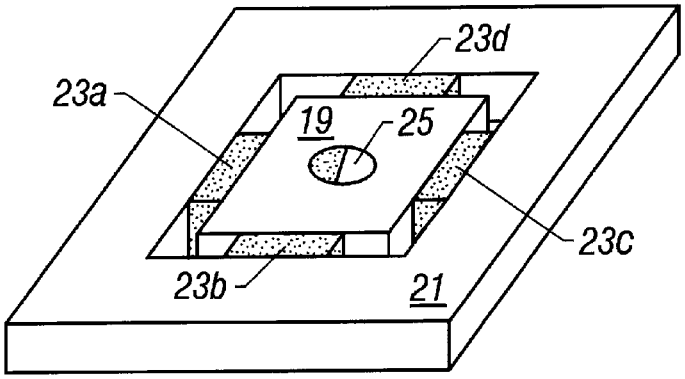
FIG. 10 is a diagram showing an example of a mechanism which has a physical insensitive zone and which detects horizontal indication given by the stick 1.

As shown in FIG. 10, there is a method which fixes a force detecting plate 19 to a plate support board 21 through pressure sensors 23*a*, 23*b*, 23*c*, and 23*d* such as piezo elements. The force detecting plate 19 is formed with a hole 25 into which the stick 1 (not shown) is inserted. When the stick 1 pushes the hole 25 in a horizontal direction, the force detecting plate 19 will be pushed, and the pressure sensors 23*a*, 23*b*, 23*c*, and 23*d* will detect changes in the pressure, respectively. With the result of the detection, it is detected in which direction and to what extent a force is applied.

Figure 11:
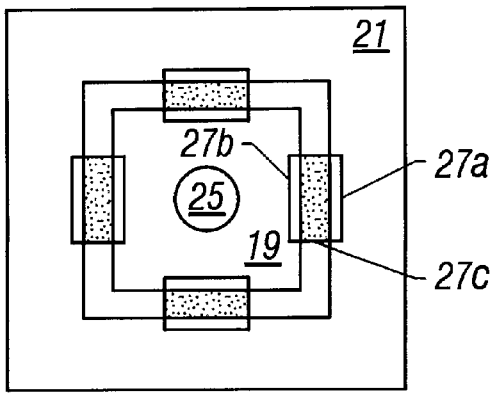
FIG. 11 is a diagram showing an example of a mechanism which has a physical insensitive zone and which detects horizontal indication given by the stick 1.

As a method of detecting force, there is another method using electrostatic capacity change in addition to pressure sensors. For example, as shown in FIG. 11, a capacitor 27 is provided at the place where the pressure sensor was provided. More specifically, a first electrode 27*a* is provided on the inner side of a plate support board 21 and a second electrode 27*b* is provided on the outer side of the plate support board 21. Between the two electrodes a dielectric substance 27*c* is interposed. With this arrangement, if a hole 25 is pushed by the stick 1 (not shown) horizontally, the force detecting plate 19 will be pushed and the electric capacities of the four capacitors will change. By detecting these changes, the direction and strength of the force applied by the stick can be detected.

While the outer configuration of the force detecting plate 19 has been shown as a rectangular or a square, the present invention is not limited to these configurations. For example, the plate 19 may be circular or polygonal in shape. Also, the number of pressures sensors and the number of electrostatic capacity sensors are not limited to four, but more sensors can be employed. In addition, the number of sensors can be determined according to the outer configuration of the force detecting plate 19. It is preferable that the inner configuration of the plate support board 21 be matched with the outer configuration of the force detecting plate 19, but it is not limited to that configuration. Other configurations are also possible if they can stably support the force detecting plate 19 and if sensors can be easily provided.

Although not mentioned in the description of the scaffold type, the outer configuration of the ring 3 does not need to be matched with the inner configuration. As shown in the example of the plate sliding type, the outer configuration of the ring 3 may be square or polygonal in shape.

(b) Mechanism of Detecting Vertical Force

In the example of FIG. 2 the switch was joined to the lower end of the stick 1. For example, in FIG. 12 an elastic body 29 for returning the stick 1 to its initial position is joined to the lower end of the stick, and a switch 31 is joined to the elastic body. Here, a force detecting member such as the ring 3 is omitted. Since the switch 31 inputs only ON/OFF information, pressure sensors can be provided instead of the switch 31 as needed. In such a case, an analog signal can be input.

Figure 12:
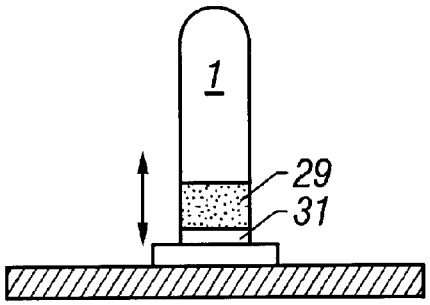
FIG. 12 is a diagram showing an example of a mechanism which detects a force in a direction perpendicular to a mounting surface 7.
Figure 13:
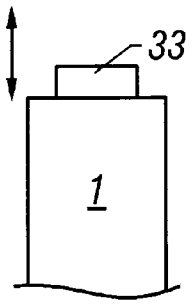
FIG. 13 is a diagram showing an example of a mechanism which detects a force in a direction perpendicular to a mounting surface 7.
Figure 14:
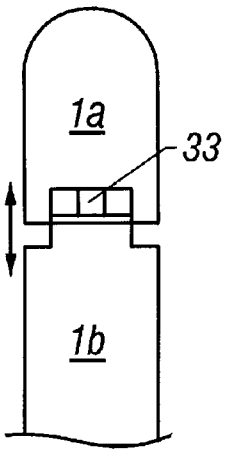
FIG. 14 is a diagram showing an example of a mechanism which detects a force in a direction perpendicular to a mounting surface 7.

In the example of FIG. 12 the switch 31 is positioned at the lower end of the stick 1. However, the present invention is not limited to a position such as this. For example, it is also possible to provide the switch 33 on the upper end of the stick 1, as shown in FIG. 13. However, if the switch 33 can be easily depressed, the stick 1 cannot be freely controlled and therefore the switch 33 need to be constructed so that it is depressed only when sufficient force is applied. In addition, as shown in FIG. 14 (which is a vertical sectional view), the switch 33 can be provided in the intermediate portion of the stick 1. That is, the upper portion 1*a* of the stick 1 is formed with a recess portion, while the lower portion 1*b* is formed with a protruding portion. The switch 33 is provided on the upper end of the lower portion 1*b*. With this arrangement, the switch 33 is turned on when the upper portion 1*a* of the stick 1 is pushed down. Conversely, the upper portion 1*a* and the lower portion 1*b* may be formed with a protruding portion and a recess portion, respectively. In this case the switch 33 is provided on the recess portion of the lower portion 1*b* so that the switch 33 is turned on by the protruding portion of the upper portion 1*a* of the stick 1 when the stick 1 is pushed down.

While a description has not been made of the design of the upper end of the stick 1, the surface may be processed or a cap made of another material may be provided so that users can easily manipulate the stick 1.

(c) Mechanism of Returning and Holding the Stick 1 to its Initial Position

Figure 15:
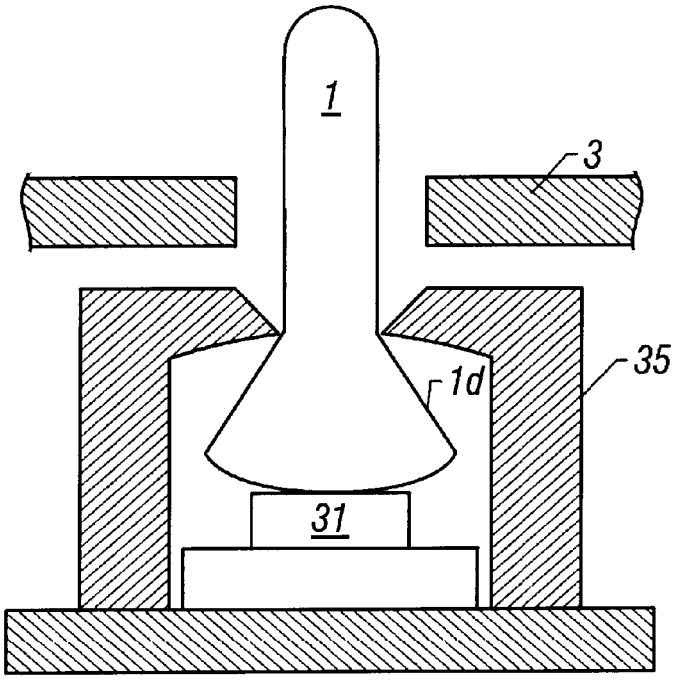
FIG. 15 is a vertical sectional view showing an example of a mechanism which returns and holds the stick 1 to its initial position.
Figure 16:
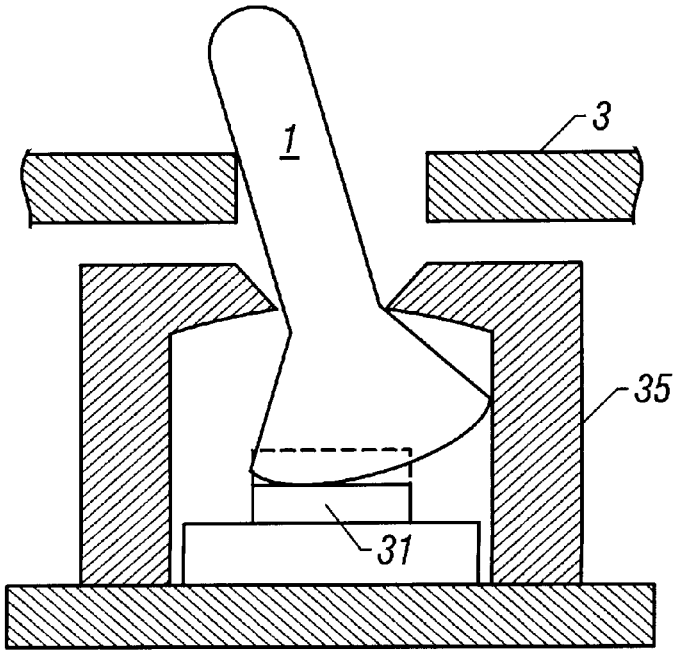
FIG. 16 is a vertical sectional view showing the state in FIG. 15 when the stick 1 is tilted.

The first example will be described with FIGS. 15 and 16 which are vertical sectional views. As shown in FIG. 15, the lower portion of a stick 1 is formed with a taper portion 1*d*. In this example, although the lower portion of the stick 1 is not joined to the switch 31, the lower portion contacts with the switch 31 in the initial state. This stick 1 is held by a stick holding mechanism 35. A ring or a force detecting plate 3 is provided above the stick holding mechanism 35. In this initial state, if the stick 1 is depressed, the switch 31 will be pushed by the lower end of the stick 1 and a selection signal will be generated.

Thereafter, if the stick 1 is tilted so as to contact with the ring or the force detecting plate 3, the center of the stick 1 will be shifted from the rotational axis by the lower taper portion of the stick 1, and the switch will be depressed by an infinitesimal amount. The dotted line portion of FIG. 16 represents the initial position of the switch 31 and the solid line portion represents the state where the stick 1 was depressed an infinitesimal amount. Even if the switch is depressed an infinitesimal amount in this way, no selection signal is generated and the restoring force of the spring of the switch 31 acts. Then, if the stick 1 is released, it will be returned to the initial position by the restoring force of the spring of the switch 31. In this way, the stick 1 can be returned and held to the initial position. The stick holding mechanism 35 need to be constructed so that the switch 31 does not make a signal even when the stick 1 is maximally tilted.

Figure 17:
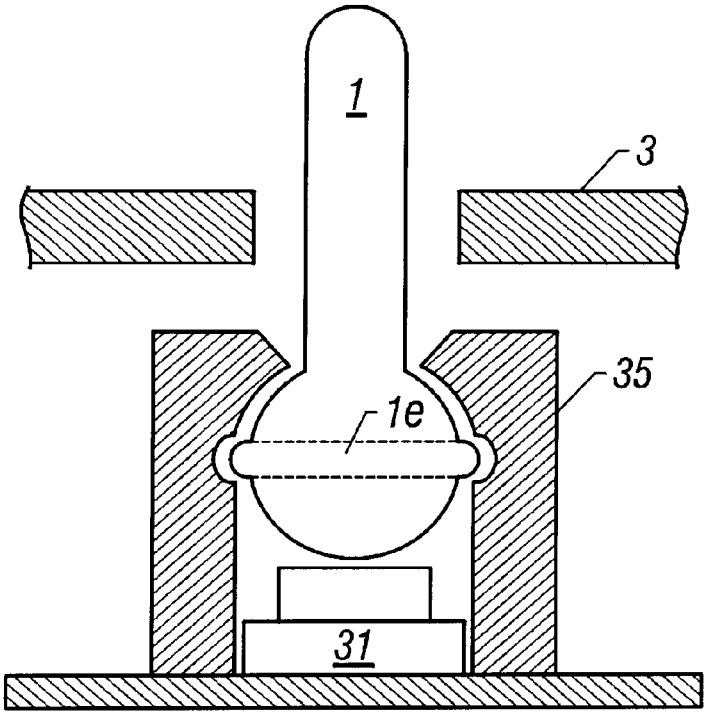
FIG. 17 is a vertical sectional view showing an example of a mechanism which returns and holds the stick 1 to its initial position.

The second example will be described with FIG. 17 which is a vertical sectional view. The lower portion of a stick 1 is formed into a spherical shape, and a protrusion 1*e* is provided near the equator of the spherical shape. On the other hand, the stick holding mechanism 35 has a configuration which can hold the lower spherical portion of the stick 1, and the mechanism 35 is formed with a groove in correspondence with the protrusion 1*e*. Above this stick holding mechanism 35 there is provided the ring or the force detecting plate 3. The switch 31 need not to be held in contact with the lower end portion of the stick 1. If the stick 1 is pushed downward, the pressure will cause the protrusion 1*e* to be disengaged from the groove of the stick holding mechanism 35, and the stick 1 will be moved downward. Consequently, the switch 1 is depressed. The stick 1 is returned to the original position by the spring of the switch 31 and the inclination of the groove of the stick holding mechanism 35. In the case of such a structure, a feeling of click can be given to the user's fingers when the protrusion 1*e* is disengaged from the groove.

Also, when the stick 1 is tilted, the protrusion 1*e* is disengaged from the groove formed in the stick holding mechanism 35. However, the stick 1 is returned to the original position by the inclination existing near the groove. In the case where the stick 1 is tilted with a large angle, the switch 31 is depressed an infinitesimal amount and therefore the stick 1 is returned to the original position by making use of the restoring force of the spring of the switch 31. If this configuration is adopted, a feeling of click can also be given to the user's fingers even when the stick 1 is tilted.

Figure 18:
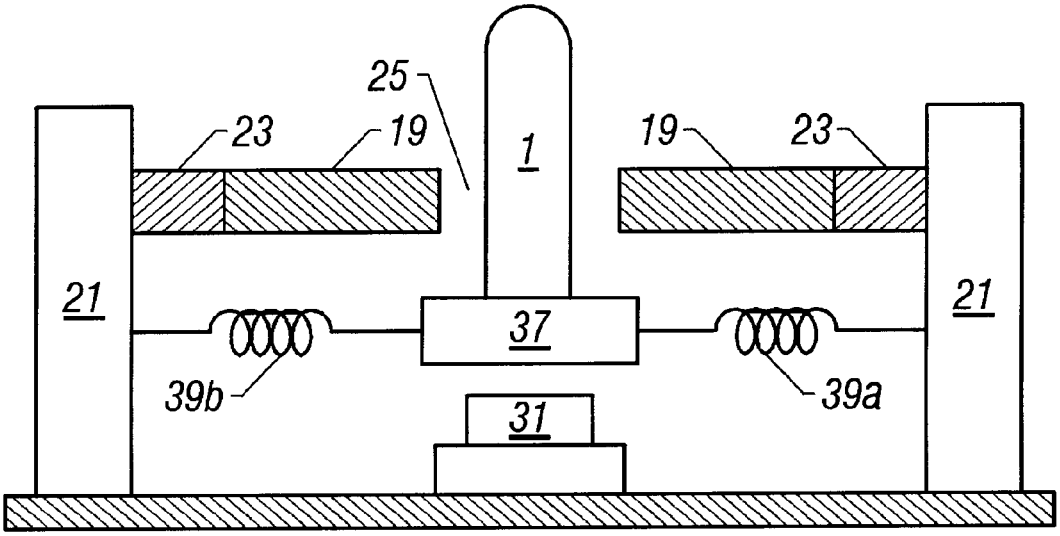
FIG. 18 is a vertical sectional view showing an example of a mechanism which returns and holds the stick 1 to its initial position.

In the mechanism of detecting horizontal indication, when the plate sliding mechanism is adopted, the detecting mechanism will be simple if the following mechanism is adopted. In FIG. 18 which is a vertical sectional view, a plate support board 21 supports a force detecting plate 19 through a pressure sensor 23. A stick 1 is held so as to protrude upward from the hole 25 of the force detecting plate 19. This stick 1 is supported by a stick support plate 37, which in turn is held by means of elastic bodies 39*a* and 39*b* such as rubber or springs. The number of elastic bodies 39 is not limited to the two elastic bodies. The elastic bodies are provided so that the stick support plate 37 can be fixed loosely. The positions at which the elastic bodies are provided are likewise determined so that the stick support plate 37 can be fixed loosely. A switch 31 is provided under the stick support plate 37. In this embodiment the stick support plate 37 and the switch 31 need not to be in contact with each other.

Thus, since the stick 1 is loosely fixed, it can be returned to the initial position by the restoring force of the elastic body 39 even when the stick 1 is depressed downward to depress the switch 31 or even when the stick 1 is tilted or slid to push the force detecting plate 19 in a horizontal direction.

While various variations are possible in addition to the aforementioned, hardware satisfying the mechanical features of the pointing device of the present invention is completed by combining (a) a mechanism having a physical insensitive zone and detecting horizontal indication made by the stick 1, (b) a mechanism for detecting a force in a direction perpendicular to the mounting surface 7, (c) a mechanism for returning and holding the stick 1 to the initial position, and the variations of the mechanisms.

(2) Signal Processing

Infinitesimal signals resulting from strain change, pressure change, and electrostatic capacity change are output from the horizontal-vector detecting sensors. These signals are amplified by amplifiers and are processed by a signal processor. In a signal processor which handles only digital signals, analog signals are first converted to digital signals by A/D converters and then the digital signals are processed. In a signal processor which can handle analog signals, the output of the amplifier can be employed as it is. This signal processor handles signals from a plurality of sensors and outputs signals corresponding to the direction and strength of an applied force in a processing manner known in background art. For example, it outputs signals such as V for an x-axis direction and W for a y-axis direction.

In this embodiment, only the direction and strength of an applied force are output. From such signals, it is determined by another program how a cursor is moved on the screen of a display unit and how the screen is scrolled. For example, the signals are used to indicate a position on the screen or determine the moving direction, speed, or acceleration of the cursor or scrolling. In the present invention, a signal V in an x-axis direction and a signal W in a y-axis direction, described above, are given to the program of an information processing apparatus by the signal processor.

In the present invention, signal processing becomes necessary not only for horizontal indication but also for vertical indication. In the case where vertical indication is performed by a switch, simply the ON/OFF signal of the switch can be given to the program of the information processing apparatus. However, in the case of a sensor which outputs an analog signal, such as a pressure sensor, there is the need to process the analog signal. The analog signal in a vertical direction is only one direction, so only a signal representing strength of force is output. In such a case, this signal representing strength of force is converted to a digital signal. The digital signal is output to a requisite program within the information processing apparatus. The signal generally is employed to indicate the amount of vertical movement in three-dimensional space.

(3) Manipulation Process

Figure 19:
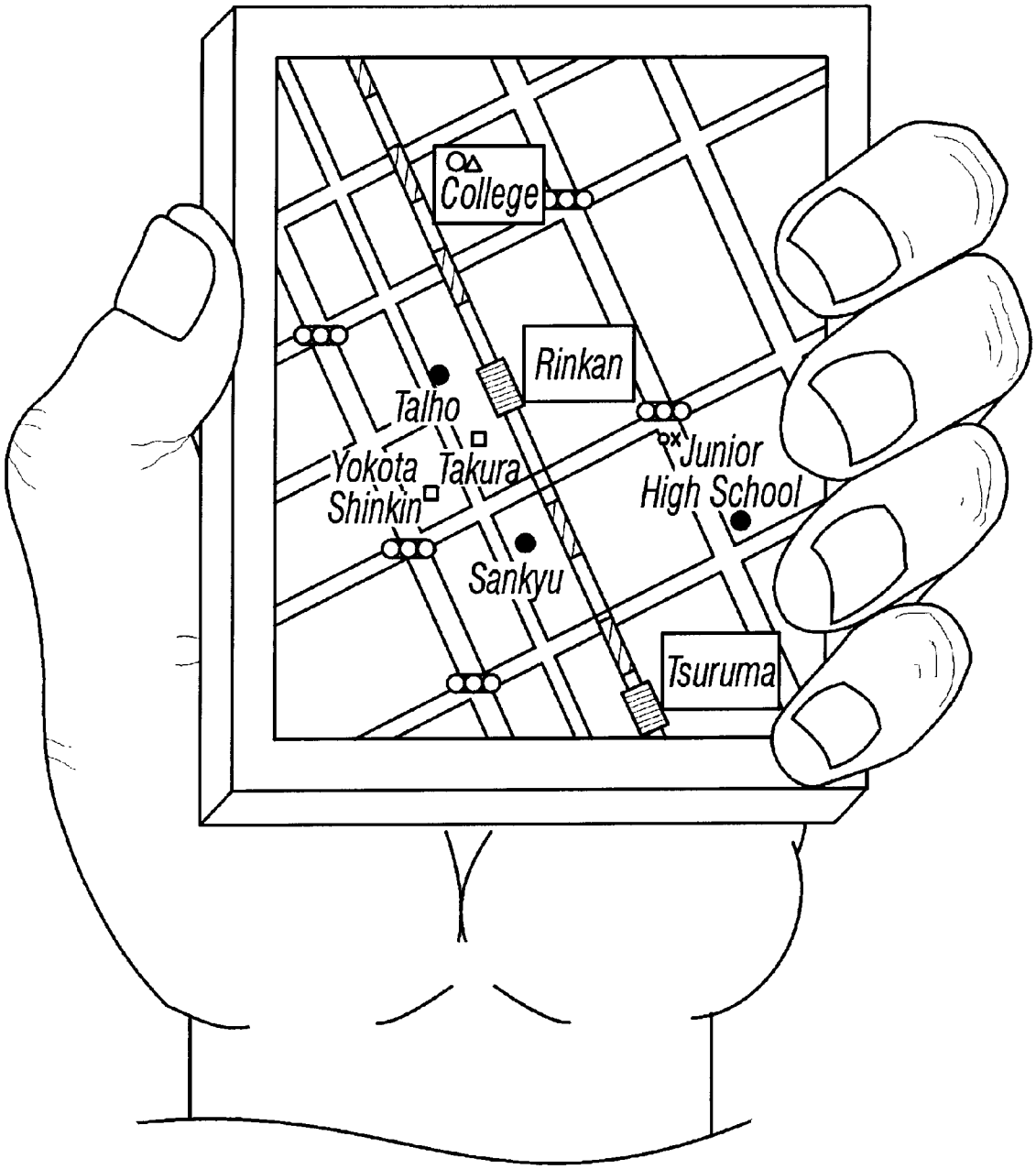
FIG. 19 is a diagram showing an example of another use for a method of manipulating the present invention.

As described in the column of Background art, a process is required which can generate both an analog input and a digital input from one pointing device. For example, in addition to the change of a focused item to indicated directions shown on the left side of FIG. 1 (processing by a digital input) and the scrolling of the screen shown on the right side of FIG. 1 (processing by an analog input), there are single-item movement and item movement according to an analog input. The combination of item movement and screen scrolling can also be used in the case where items are scattered on the screen like FIG. 19, a cursor is moved to an item in the direction of a digital input by the digital input and the display screen is scrolled in the direction of an analog input by the analog input. Furthermore, in the case where a portable information processing apparatus is a television set, the channel can be switched when a digital signal is input, and the volume can be varied when an analog signal is input.

Figure 20:
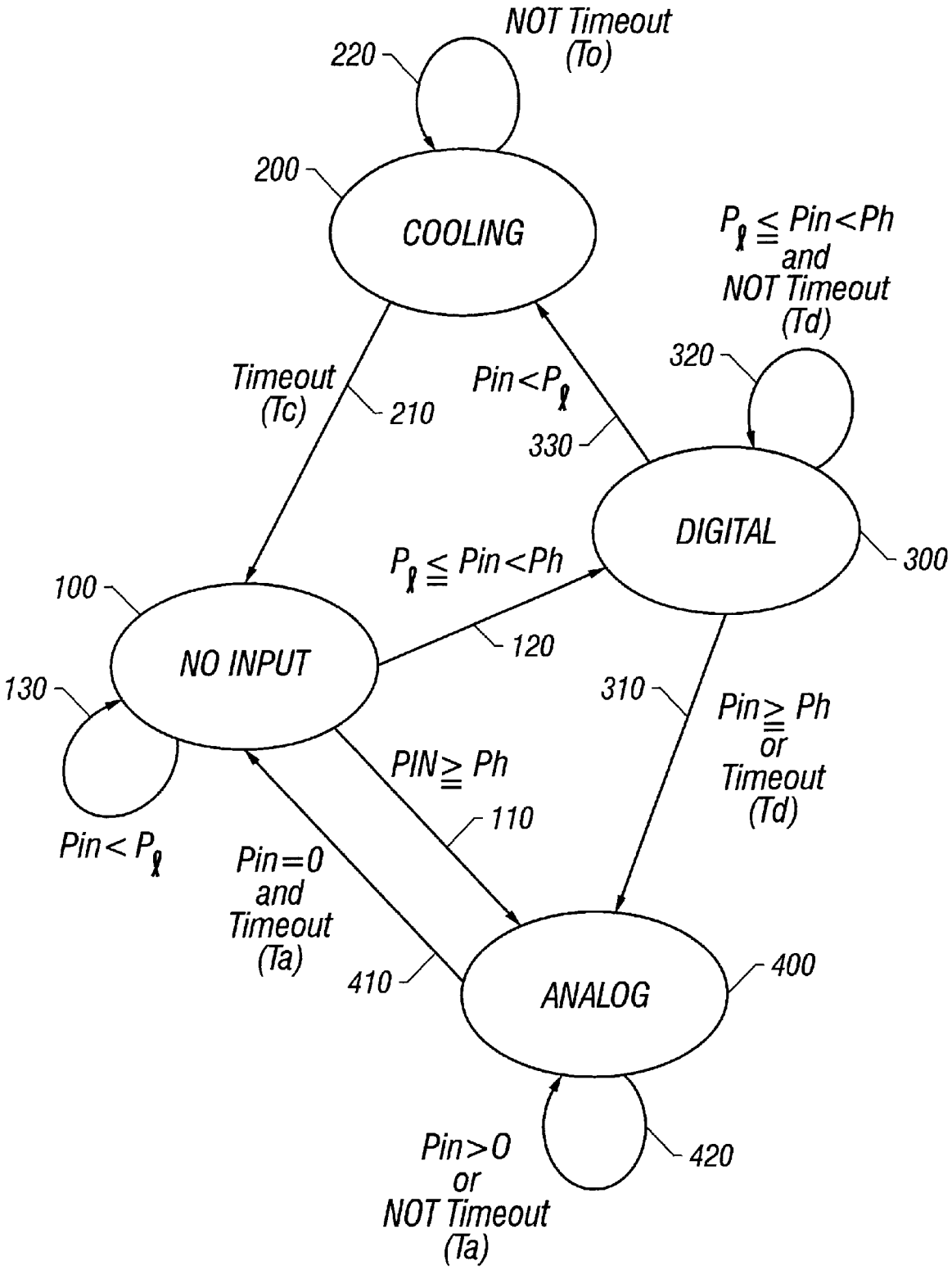
FIG. 20 is a diagram showing a state machine for controlling an information processing apparatus.

The switching between a digital input and an analog input is performed by a state machine such as that shown in FIG. 20. In the state machine of FIG. 20, both the strength of force $P_{in}$ from the pointing device and time information for time-out processing are input, and there are provided four states. In the following description, the strength of force $P_{in}$ and the time information are handled as evaluation values and state transition is caused by the evaluation values, but state transition may be caused by evaluating the amount of change and the direction of an applied force. Since the inputs from the pointing device generally are signals V and W in x-axis and y-axis directions, the evaluation value $P_{in}$ employs a value such as $(V^2+W^2)^{0.5}$. The states are NOINPUT state 100 representing an initial state and a no-input state, COOLING state 200 which is a cooling-off state for preventing chattering, DIGITAL state 300 in which a digital input is being processed, and ANALOG state 300 in which an analog input is being processed.

As previously shown, the initial state is the NOINPUT state 100. In the case where an input strength of force $P_{in}$ is less than $P_l$, the current state stays in this NOINPUT state 100, as shown by 130 in FIG. 20. This $P_l$ is a threshold value which means that an input less than this value is ignored. The aforementioned mechanical structure of the embodiment of the present invention has the physical insensitive zone, so no force will be detected even if the stick 1 is slightly tilted. Therefore, in a mechanical structure such as described above, this $P_l$ can be taken to be zero. However, since there are cases where the stick 1 slightly contacts with the ring 3 by mistake and then some value is detected, it is also possible to set $P_l$ to an appropriate value. Next, when $P_l \leqq P_{in} < P_h$, a transition is made from the NOINPUT state 100 to the DIGITAL state 300, as shown by 120. The $P_h$ is a second threshold value which determines whether a transition to an analog input is made or not. If $P_{in} \geqq P_h$, a transition will be made from the NOINPUT state 100 to the ANALOG state 400, as shown by 110. At this time, the analog input processing of the strength of force $P_{in}$ is performed for the direction of an applied force.

After the transition to the DIGITAL state 300, in the case where a force equal to or greater than $P_l$ and less than $P_h$ continues to be applied, the current state stays in the DIGITAL state 300 until time-out $T_d$, as shown by 320. When the applied force becomes less than $P_l$, a transition is made from the DIGITAL state 300 to the COOLING state 200, as shown by 330. When this transition is made, digital input processing is performed for the direction of the applied force. For the direction, a digital input may be made in one direction of 4 directions or 8 directions which have previously been prescribed. On the other hand, in the case where the applied force is less than $P_h$ but thereafter becomes equal to or greater than $P_h$ or in the case where a force less than $P_h$ is being applied but the time becomes greater than time-out $T_d$, a transition is made from the DIGITAL state 300 to the ANALOG state 400, as shown by 310. During this transition, the analog input processing of the strength and the direction of the applied force is performed.

If once a transition to the COOLING state 200 is made, the current state will stay in this COOLING state 200 until time-out $T_c$ elapses, as shown by 220. After time-out $T_c$ elapses, the state returns to the NOINPUT state 100 which is an initial state, as shown by 210.

If, on the other hand, a transition to the ANALOG state 400 is made, the current state will stay in the ANALOG state 400 when the applied force is greater than zero or in the case where time-out $T_a$ has not elapsed even when the force is zero, as shown by 420. During this stay, the analog input processing of the direction and strength of the applied force is performed. If an applied force is 0, the input will be handled as 0. In this state, both the direction in which force is applied and the strength can be varied, and analog input processing is performed in correspondence with the variation. Then, if the period during which $P_{in}=0$ passes time-out $T_a$, the ANALOG state 400 will return to the NOINPUT state 100, as shown by 410.

$P_h$ is determined by both the relation with $P_l$ and the hardware structure. That is, in the case where the difference between $P_l$ and $P_h$ is small, even when a signal was input with the intention of a digital input, it would determined as an analog input, and consequently, this determination is inconvenient to users. If, on the other hand, $P_h$ is too large, force will be increased to input an analog signal. Consequently, user's fingers will easily get fatigued or the pointing device need to be structurally reinforced. $T_a$, $T_d$, and $T_c$ also need to be determined in view of convenience and hardware structure.

The present invention is not limited to the aforementioned definition of state and how to make a transition. For example, while the COOLING state 200 has been defined, the present invention can be carried out without this definition. Also, while the present invention has been constructed so that a transition is made from the DIGITAL state 300 to the ANALOG state 400 when time-out $T_d$ elapses and when $P_l \leqq P_{in} < P_h$, such time-out does not always need to be defined.

In the mechanical structure of the embodiment of the present invention, it has been described that an analog input is also made possible for a vertical direction. In such a case, the state machine of FIG. 20 can be employed to indicate this vertical direction. That is, a digital input and an analog input are controlled by the manner in which vertical force is applied.

While the foregoing description has been based on the aforementioned mechanical structure of the embodiment of the present invention, the range of application of the aforementioned state machine is not limited to the aforementioned mechanical structure. That is, in addition to the pointing device shown in FIG. 2 provided with (a) a mechanism having a physical insensitive zone and detecting horizontal indication made by the stick 1, (b) a mechanism for detecting a force in a direction perpendicular to the mounting surface 7, and (c) a mechanism for returning and holding the stick 1 to the initial position, the state machine is applicable to a conventional pointing device such as a track ball, a mouse, a joy stick, or a pointing device on a keyboard which is described in Japanese Published Unexamined Patent Application No. 7-302162.

Since such a conventional pointing device does not have a physical insensitive zone, it is difficult for users to obtain a feeling of click when a digital signal is input. However, it is possible to execute a digital input and an analog input in accordance with the state machine shown in FIG. 20 by the amount of rotation of the ball of a mouse or a track ball or the amount of inclination of the stick of a joy stick. In this case a conventional pointing device requires an additional switch for selection. In the pointing device of the embodiment of the present invention, digital and analog inputs, and selection can be performed without releasing user's hold of the stick and employing another finger, so it can be said that the invention is a more suitable pointing device for the purpose.

While the pointing device of the present invention is employed with a mind to a portable information processing apparatus, it is also possible to separately make this pointing device to connect to normal information processing apparatuses or to place at an appropriate position on a keyboard. The connection of the pointing device to normal information processing apparatus can be made by wire or radio. In addition to information processing apparatuses, it is also possible to provide the pointing device of the present invention in a remote controller of a television set for indicating channel change by a digital input and volume change by an analog input. Even in such a case, digital and analog inputs, and selection (a vertical analog input as needed) can be performed with a single stick, so the pointing device of the present invention becomes more convenient.

Figure 21:
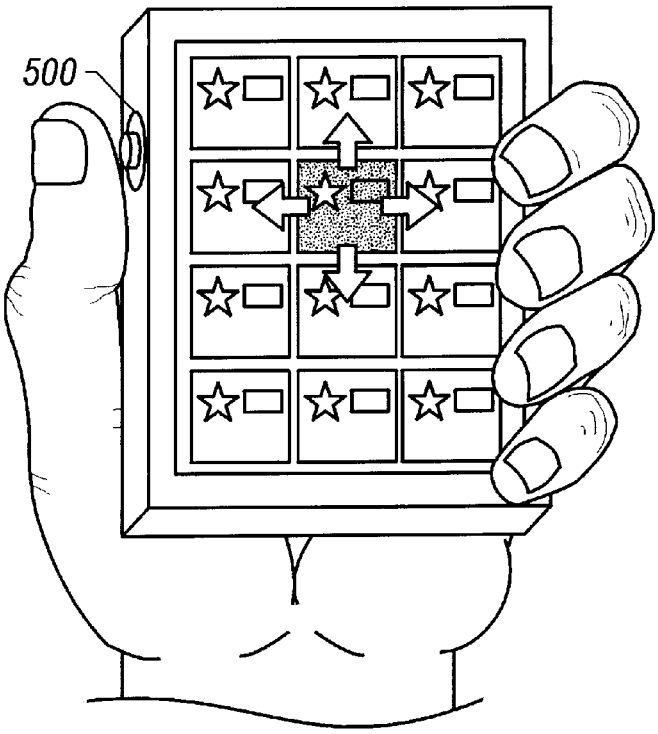
FIG. 21 is a diagram showing an example of a pointing device provided on the side surface of an information processing apparatus.
Figure 22:
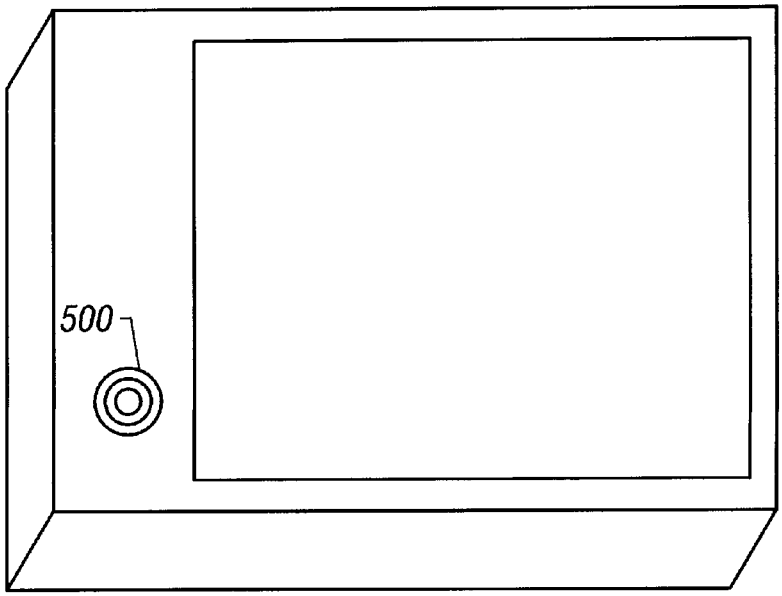
FIG. 22 is a diagram showing an example of a pointing device provided on the front surface of an information processing apparatus.

Even in the case where the pointing device of the present invention is provided in a portable information processing apparatus which is the original usable form, there is the case where a pointing device 500 is provided on the side surface of the information processing apparatus such as that shown in FIG. 21 (the stick becomes substantially parallel to a display device), the case where a pointing device 500 is provided on the surface of the display device of an information processing apparatus such as that shown in FIG. 22, and the case where the pointing device is provided on the opposite surface of the display device.

What is claimed is:

1. A pointing device comprising:

a stick having an axis;

a vector detection mechanism located around and physically spaced apart from the stick to define an empty void and physically insensitive zone therebetween, wherein the vector detection mechanism does not detect motion of the stick, and wherein the vector detection mechanism outputs a signal corresponding to a contact direction and the strength of a force applied in the contact direction when the stick physically contacts the vector detection mechanism; and a detector for detecting a force applied in an axial direction of the stick.

2. The pointing device as set forth in claim 1, further comprising a mechanism for returning the stick shifted from its initial position to the initial position.

3. The pointing device as set forth in claim 1, wherein the detector for detecting a force is a switch.

4. The pointing device as set forth in claim 3, wherein the switch is provided in the stick.

5. The pointing device as set forth in claim 3, wherein the switch is provided at a position which is pushed by one end of the switch when the other end of the stick is pushed in the axial direction of the stick.

6. The pointing device as set forth in claim 1, wherein the vector detection mechanism comprises:

a member placed around the stick so as to be away from the stick by a predetermined distance and having a circular portion which is contacted by the stick; and a sensor for detecting the strength and direction of a force applied to the member by the stick.

7. The pointing device as set forth in claim 6, wherein the vector detection mechanism further comprises a support member which supports the member and wherein the sensor detects the strength and direction of a force applied to the member, the force transmitted through the support member.

8. A portable information processing apparatus comprising:

a pointing device comprising a stick having an axis, a vector detection mechanism physically spaced apart from the stick by a predetermined distance so as to surround the stick and define an empty void and a physically insensitive zone therebetween, wherein the vector detection mechanism does not detect motion of the stick within the physically insensitive zone, and wherein the vector detection mechanism outputs a signal corresponding to a contact direction and the strength of a force applied in the contact direction when the stick physically contacts the vector detection mechanism, and a detector for detecting a force applied in an axial direction of the stick; and a display device.

9. The portable information processing apparatus as set forth in claim 8, wherein the axis of the stick is provided substantially parallel to the display device.

10. A method for operating an information processing apparatus having a pointing device, comprising the steps of:

in response to an input signal from the pointing device, judging whether an evaluation value of the input signal satisfies a predetermined condition;

performing a first kind of operation according to the evaluation value when the evaluation value satisfies the predetermined condition; and performing a second kind of operation when the evaluation value does not satisfy the predetermined condition; and wherein the pointing device comprises:

a stick having an axis;

a vector detection mechanism physically spaced apart from the stick by a predetermined distance around the stick and define an empty void and a physically insensitive zone therebetween, wherein the vector detection mechanism does not detect motion of the stick within the physically insensitive zone, and wherein the vector detection mechanism outputs a signal corresponding to a contact direction and the strength of a force applied in the direction when the stick physically contacts the vector detection mechanism; and a detector for detecting a force applied in an axial direction of the stick.

11. The method as set forth in claim 10, wherein the first kind of operation is operation which is continuously performed and the second kind of operation is operation which is performed one unit at a time.

12. The method as set forth in claim 11, wherein the first kind of operation is operation which scrolls the screen of a display device of the information processing apparatus and the second kind of operation is operation which changes a focused item on the screen.

13. The method as set forth in claim 10, further comprising the steps of:

in response to an input signal from the pointing device judging whether the evaluation value satisfies a second predetermined condition;

performing the judging step and the steps thereafter when the evaluation value satisfies the second predetermined condition; and ignoring the input signal when the evaluation value does not satisfy the second predetermined condition.

14. The method as set forth in claim 10, further comprising a step of selecting an item on the screen of the display device of the information processing apparatus in response to an output from the detector.

15. A portable information processor comprising:

a pointing device comprising a stick having an axis, a vector detection mechanism located around and physically spaced apart from the stick by a predetermined distance so as to surround the stick and define an empty void and a physically insensitive zone, wherein the vector detection mechanism is incapable of detecting motion of the stick, and wherein the vector detection mechanism outputs a signal corresponding to a force vector of a force applied by the stick when the stick physically contacts the mechanism, and a detector for detecting a force applied in an axial direction of the stick; and a controller for, in response to a signal output from the vector detection mechanism, judging whether an evaluation value of the force vector satisfies a predetermined condition, and for instructing the execution of a first kind of operation according to the evaluation value when the evaluation value satisfies the predetermined condition, and for instructing the execution of a second kind of operation when the evaluation value does not satisfy the predetermined condition.

* * * * *